United States Patent [19]

Fisher et al.

[11] 4,154,161

[45] May 15, 1979

[54] SIDE-LOADING PULP PRESS

[75] Inventors: Robert E. Fisher, Larkspur; Wallace J. S. Johnson, Berkeley, both of Calif.

[73] Assignee: Up-Right, Inc., Berkeley, Calif.

[21] Appl. No.: 838,896

[22] Filed: Oct. 3, 1977

[51] Int. Cl.[2] ..... B30B 9/06; B30B 3/04

[52] U.S. Cl. ..... 100/51; 100/121; 100/127; 100/192; 100/139; 100/233

[58] Field of Search ..... 100/45, 51, 104, 110, 100/111, 112, 116, 121, 126–129, 191, 192, 233–236, 139, 170, 37, 47, 50

[56] References Cited

U.S. PATENT DOCUMENTS

| | | | |
|---|---|---|---|
| 801,963 | 10/1905 | Beaty | 100/233 X |
| 1,748,374 | 2/1930 | Winger | 100/170 |
| 1,834,852 | 12/1931 | Kutter | 100/121 |
| 2,398,135 | 4/1946 | Roza, Sr. | 100/112 |
| 2,587,997 | 3/1952 | Guettler | 100/126 |
| 2,705,916 | 4/1955 | Millgard | 100/116 X |
| 3,416,438 | 12/1968 | Weatherly et al. | 100/233 X |
| 3,527,668 | 9/1970 | Kusters et al. | 100/121 X |
| 3,980,014 | 9/1976 | McEwen et al. | 100/127 |

*Primary Examiner*—Peter Feldman
*Attorney, Agent, or Firm*—Phillips, Moore, Weissenberger, Lempio & Majestic

[57] ABSTRACT

A press comprising an apertured press box which opens on a side parallel to its axis to admit the product to be pressed. After closing of the press box a ram is forced axially through the press box to compress the material and squeeze the liquid therefrom. A restricted opening is then formed at the end of the press box and the material in the cylinder is extruded therethrough.

13 Claims, 13 Drawing Figures

SIDE-LOADING PULP PRESS

BACKGROUND OF THE INVENTION

This invention relates to the separation of liquid and solid components of a slurry or pulpy material by pressing. In some instances, e.g., the production of paper, it is desired to squeeze the moisture from a slurry to obtain a solid product. In other instances, e.g., the production of fruit juice, it is desired to squeeze the pulp and collect the juice therefrom.

In either case, in order to be commercially practicable, the process must result in a rapid separation of the liquid and solid components of the product and must have an adequate degree of such separation.

Many products to be pressed are complex organic or inorganic materials, and the quality of the resulting liquid, or solid, is just as important as the quantity of the liquid, or solid, produced per unit time.

Wine grapes, from which the juice is to be squeezed and used in the making of wine, are a typical example of a product wherein the quality of the produced juice is very important.

Various continuous presses have been developed and used for extracting juice from grapes. For example, screw presses having a screw rotating in a perforated cylinder allow grape pulp to be fed continuously thereto, the pulp being compressed to a greater and greater degree to squeeze the juice therefrom as the pulp moves through the press. Such presses are capable of rapid and adequate separation of the juice from the seeds and skins of the grapes. However, the quality of the juice is impaired by the abrasive action of the screw in the perforated cylinder which releases tannin and other unpalatable substances from the skins and seeds.

"Basket" presses (referring to the wooden, cylindrical, spaced-stave presses of history) are generally used wherein the quality of juice is important. Such presses have a piston, or opposed pistons, reciprocating on the axis of a perforated or slotted cylinder to apply pressure to a batch of pulp and force the juice therefrom. In such operation the juice quality is high because there is very little abrasion of the solid components and the cake of compressed seeds and skins which is formed as squeezing progresses acts as a filter pad to retain minute solid particles of skins and pulps which would otherwise contaminate the extracted juice. However, such presses are inherently slow in operation since they are limited to operation on a single batch at a time. After each squeezing, the resulting cake must be removed, usually by hand, before a new batch may be pressed. Moreover, such presses are usually quite large in size so that a large quantity of pulp may be operated upon at one time. As a result, the large average distance that juice in the batch must travel in order to be discharged substantially increases the time required to obtain an adequate degree of separation of the juice from the pulp. Furthermore, with large-size presses, pockets of trapped fluid will develop in the batch, which reduces the efficiency of fluid removal.

In recent years efforts have been made to mechanize basket-type presses to reduce or eliminate the manual labor of digging the compressed cake resultant from each pressing, and to release trapped juice. Such presses usually involve opposed pistons reciprocating in a slotted or perforated cylinder. These presses are invariably large (typically a meter or more in diameter) to admit a large batch, and successively press and repress the pulp between the opposing cylinders. Chains and/or rods between the pistons fracture the cake each time the pistons withdraw. The cylinder then rotates to tumble and break up the cake before the next pressing stroke.

Such design does achieve a greater degree of separation and a higher rate of production per unit time, but two quality disadvantages are introduced thereby. The lengthy time per batch means prolonged exposure of the juice to oxidation. Further, the fracturing, tumbling and repetitive repressing of the restructured cake diminishes its capability as a filter pad, releasing minute solid particles which contaminate the extracted juice.

It is the principal object of the invention to provide an apparatus for separating liquid and solid components of a pulp which have the desirable attributes of a continuous press, i.e., a rapid and high degree of separation of the solid and liquid components while retaining the desirable quality attribute of a single-stage basket press wherein the resultant cake acts as a filter pad to prevent minute solid particles from contaminating the extracted juice.

SUMMARY OF THE INVENTION

The main object of the invention is met by providing a side-opening press box into which new pulp may be charged laterally and rapidly into the press box. A ram then moves axially through the press box, applying pressure to the pulp to squeeze the liquid therefrom while at the same time utilizing the filtering capability of the compressed solids to retain minute solid particles therein.

A further object of the invention is to then discharge the mass of solid material from the end of the press box by the single stroke of the ram, with the solid material being extruded from the press box and with the mass being reformed in shape so as to expose the entrapped semi-liquid material in the central portion of the mass to a liquid-releasing area at the end of the cylinder.

A further object of the invention is to provide an operation wherein the pulp is subjected to lateral squeezing action as it is filled into the press box and before the main ram pressure is applied thereto.

Other objects and advantages of the present invention will be apparent in the course of the following detailed description.

BRIEF DESCRIPTION OF THE DRAWINGS

In the drawings, forming a part of this application, and in which like parts are designated by like reference numerals throughout the same.

DESCRIPTION OF THE PREFERRED EMBODIMENT

Figure 1:
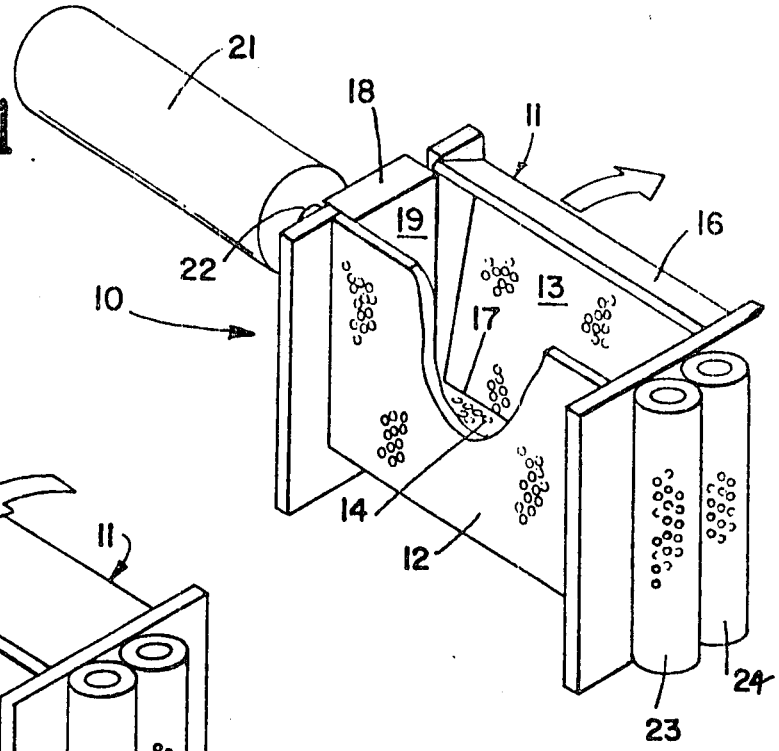
FIGS. 1–4 are simplified perspective views of a press constructed in accordance with the invention, illustrating the cooperation of the various elements thereof at different stages in a pressing cycle.

FIGS. 1-4 illustrate in general the major components and functioning of a preferred embodiment of a press utilizing the principles of the present invention. Such press, generally designated by the reference numeral 10, comprises an elongated apertured press box 11 having a uniform cross-sectional area and shape throughout its length and having opposed side wall members 12 and 13. In the preferred embodiment, the interior of press box 11 is generally rectangular in cross-section, and the press box includes a bottom wall 14 fixed to side wall 12 and an upper wall 16 integral with side wall 13. Side wall 13 is hingedly connected along its lower edge to bottom wall 14 so that it can pivot about a horizontal axis 17 which is parallel to the longitudinal axis of the press box, and can pivot between the positions shown in FIGS. 1 and 2.

Figure 2:
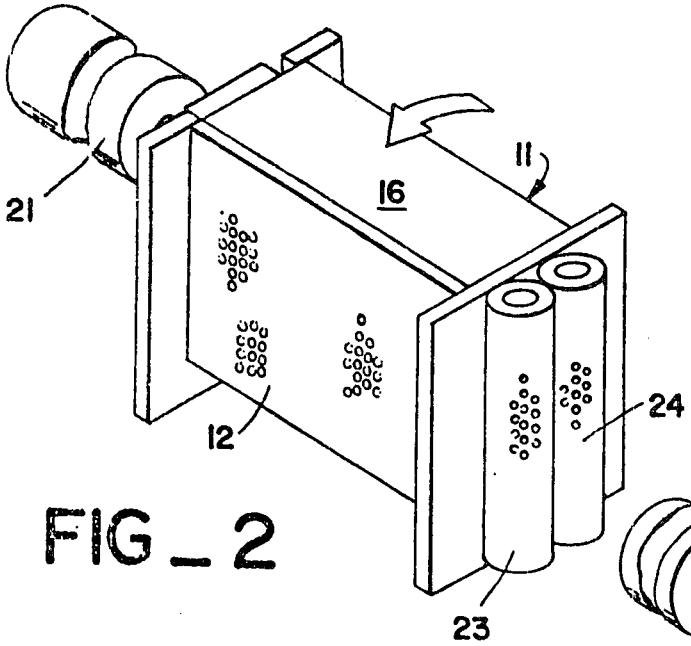

A ram 18 is provided, the ram having a cross-sectional area and shape equal to that of press box 11, the ram having a forward face 19 which forms a closure for one end of the cylinder when the latter is closed and the ram is retracted, i.e., as in FIG. 2. A hydraulic cylinder 21 having a piston 22 connected to ram 18 moves the ram through the press box 11. The other end of the press box 11 is normally closed by a pair of rollers 23 and 24.

In general, the press 10 operates as follows. Side wall 13 and upper wall 16 are pivoted to the position of FIG. 1, which opens the cylinder along the upper length thereof so that a pulpy material may be fed laterally into the press box. The cross-sectional area of the press box is enlarged when the press box is opened, making the cylinder easier to fill.

Side wall 13 and upper wall 16 are then forced back towards side wall 12 (FIG. 2) to apply a lateral compression to the pulp and to cause an initial squeezing of the liquid therefrom. If desired, side wall 13 can be re-opened and then closed again to allow more pulp to feed into the press box.

Figure 3:
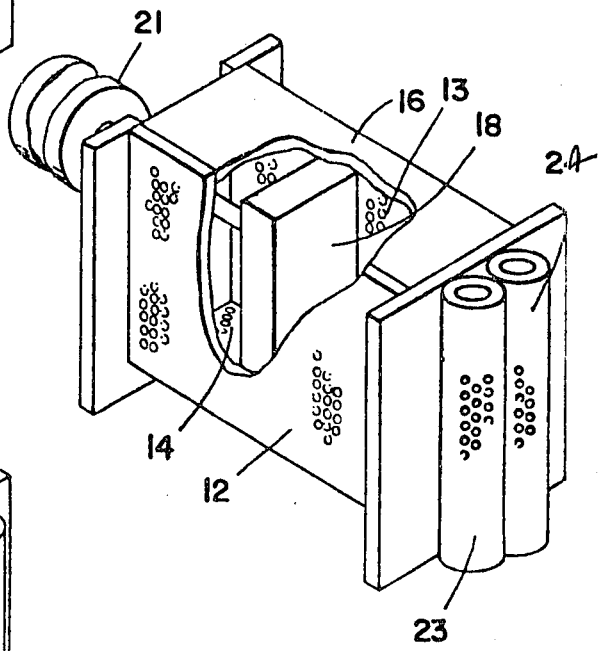

In the next step, ram 18 is forced axially through the press box to provide an axial compression of the pulp and to cause further liquid to be squeezed out of the pulp (FIG. 3).

Figure 4:
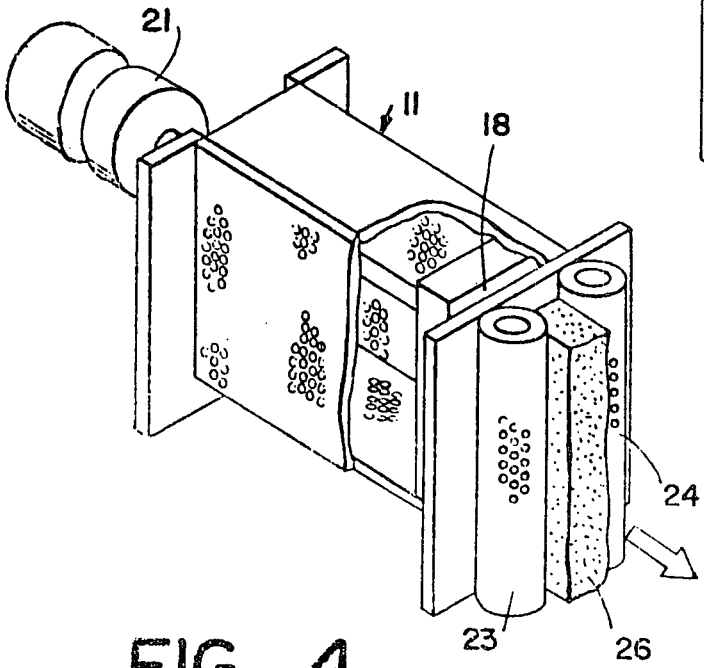

In due course, and after full ram pressure has been applied to the pulp for a time sufficient to squeeze most of the liquid from the pulp which can be readily removed by such axial pressure, the rollers 23 and 24 are moved apart to provide a restricted opening therebetween. The ram 18 then forces the solids and the still entrapped liquid out through the opening. The entrapped liquid is released and a relatively dry cake 26 of the solid components of the pulp is extruded from the press (FIG. 4).

Having cleared out the press box with this single forward stroke, the ram 18 retracts and another cycle of operation begins.

FIGS. 5-10 illustrate in greater detail a preferred embodiment of the invention. The main frame 31 comprises spaced-apart vertical end frame members 32 and 33 and transverse intermediate members 34 and 35, held together by longitudinally extending tie rods 36.

Figure 5:
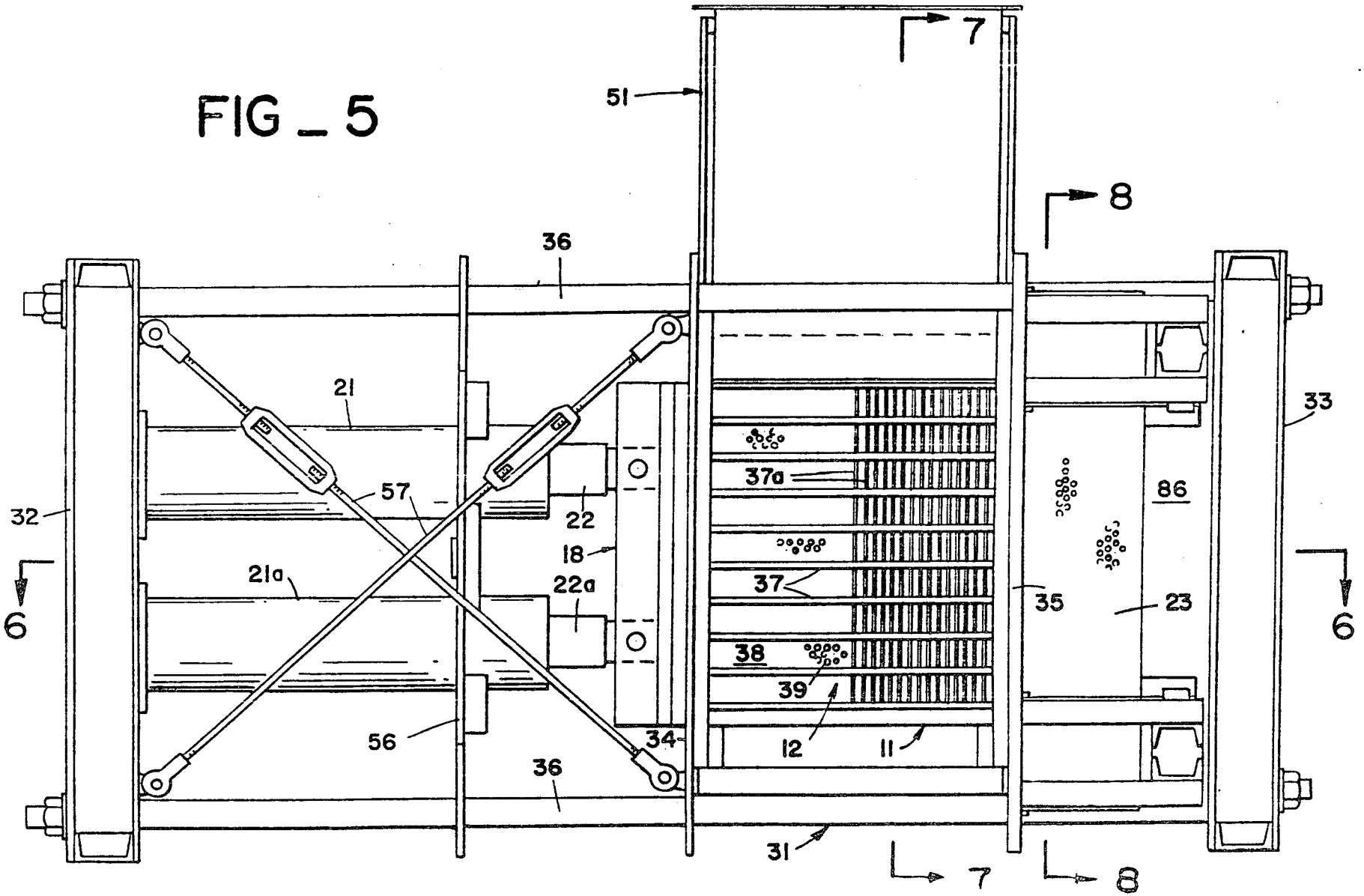
FIG. 5 is a side elevational view of a preferred embodiment of the press.
Figure 6:
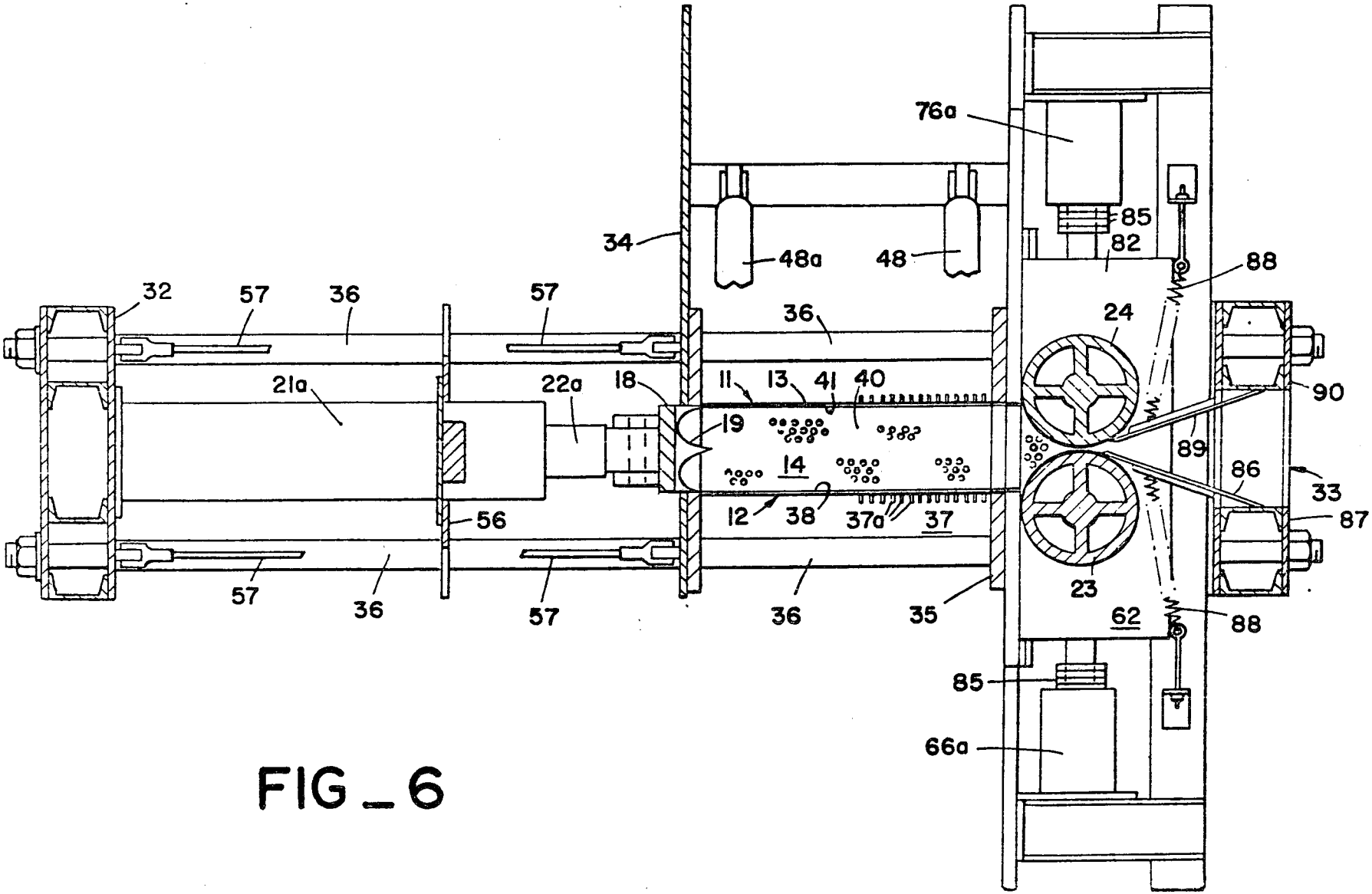
FIG. 6 is a horizontal cross-section of the press of FIG. 5 taken on line 6—6 thereof.

Side wall 12 of press box 11 extends between and is securely attached at its ends to the frame members 34 and 35. As best seen in FIGS. 5 and 6, side wall 12 includes a plurality of vertically spaced horizontal support bars 37, and a plurality of horizontally spaced vertical support bars **37*a* extending between bars 36 at the end of the side wall which is subjected to the most pressure when ram 18 is in operation. The bars 37 and 37*a* form a planar surface inside the press box against which screen 38 rests, screen 38 being provided with apertures 39 through which liquid may pass when the press is in operation. The thickness of screen 38 and the amount of support provided by bars 37 and 37*a* will, of course, depend upon the forces which the press is to withstand. The size of the apertures 39** will depend to a large degree on the particular material being processed. For example, if grapes are to be pressed, the apertures should be slightly smaller in size than the seeds of the grapes.

The bottom wall 14 likewise extends between and is secured against movement relative to frame members 34 and 35. An apertured screen 40 covers the upper surface of the bottom wall.

Side wall 13 also includes horizontal and vertical support bars which support apertured screen 41 against outwardly directed forces. Side wall 13 is mounted at its lower end on horizontal rod 17 for pivotal movement between open and closed positions. Top wall 16 is formed integrally with side wall 13 and has an imperforate plate 42 covering its under surface.

Although the side walls and bottom of the press are shown as covered by perforated screens, it is to be realized that other means may be employed to provide the desired drainage. For example, a bar screen composed of thin bars extending lengthwise of the press may be used, the bars being spaced apart sufficiently to allow drainage of liquid therethrough, while at the same time preventing passage of seeds therebetween.

Figure 7:
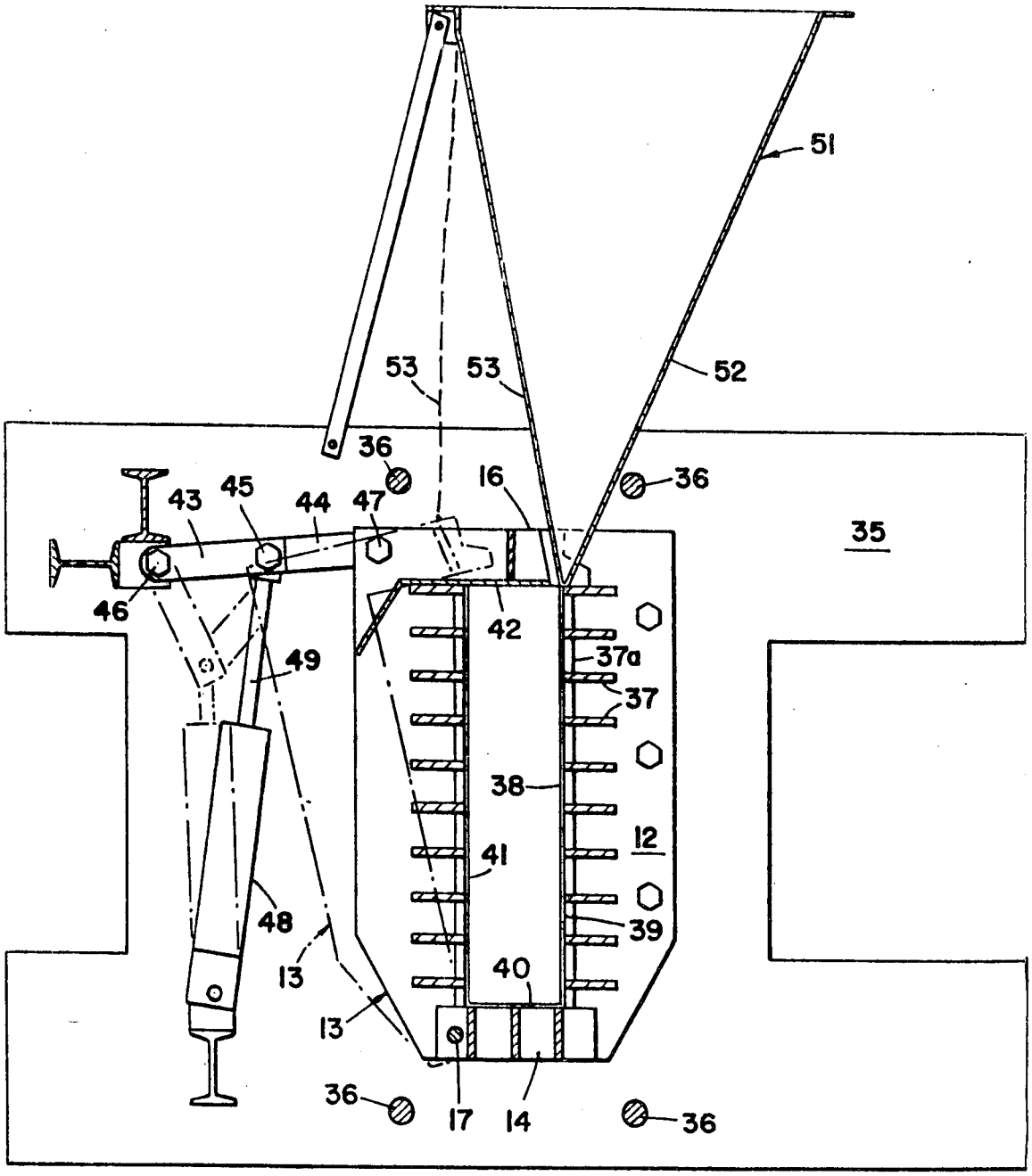
FIG. 7 is a vertical cross-section of the press of FIG. 5, taken on line 7—7 thereof.

As seen in FIG. 7, a pair of links 43 and 44 are pivotally connected to each other by link pin 45, link 43 being pivotally connected by pin 46 to the frame and link 44 being pivotally connected at 47 to the top of one end of side wall 13. A hydraulic cylinder 48 is pivotally supported on the frame and its piston 49 is connected to link pin 45. When piston 49 is extended, it forces link 43 and 44 into the solid position shown in FIG. 7 to force side wall 13 to closed position. Retraction of piston 49 pulls the links to the dotted-line position to open the side wall. A similar link arrangement, actuated by hydraulic cylinder **48*a*, is provided at the other end of side wall 13**.

Hopper 51 is mounted on the frame above press box 11, with one side 52 of the discharge chute of the hopper being connected to and extending along the upper edge of side wall 12. The opposite side 53 of the discharge chute is connected to and extends along the edge of the top wall 16. Side 53 of the discharge chute is preferably made of flexible material so that it will move easily with movement of side wall 13.

As shown in FIGS. 5 and 6, ram 18 is actuated by tandem operation of a pair of hydraulic cylinders 21 and **21*a* mounted on end wall 32 of the frame with their pistons 22 and 22*a* connected to the ram. A transverse frame assembly 56 supports the forward ends of the hydraulic cylinders. Diagonally disposed tie rods 57 extend between frame members 32 and 34 to rigidify the frame and support it against the reactive forces involved when ram 18** is in operation.

Figure 8:
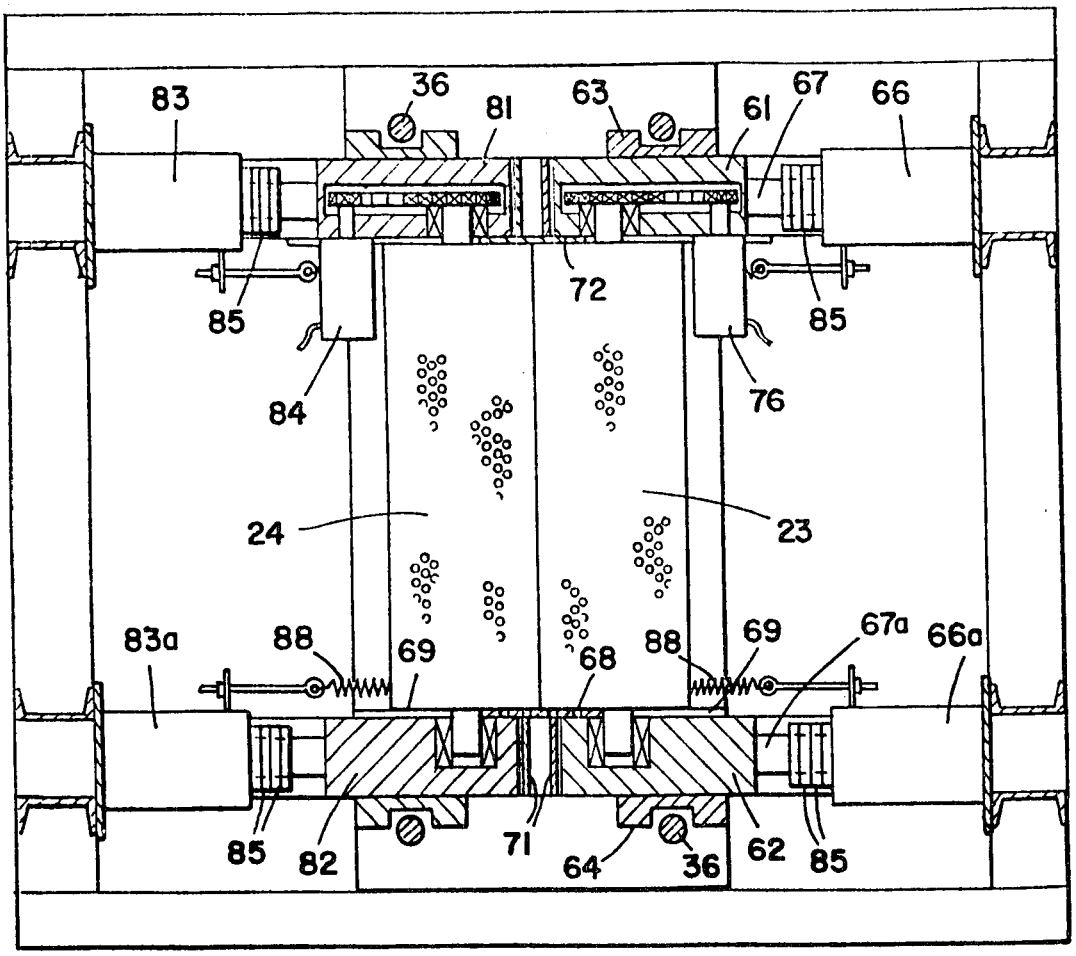
FIG. 8 is a vertical cross-section of the press of FIG. 5, taken on line 8—8 thereof.

As mentioned previously, the end of press box 11 opposite to ram 18 is normally closed by rollers 23 and 24. As best seen in FIGS. 6 and 8, the upper and lower ends of roller 23 are journaled in skate members 61 and 62, respectively, for rotation of roller 23 about a vertical axis. Skates 61 and 62 are mounted between guide members 63 and 64 which allow the skates to be moved in a translatory motion towards and away from the vertical centerline of the press while at the same time holding the skates against movement lengthwise of the press. Hydraulic cylinders 66 and 66*a* mounted on the frame have pistons 67 and 67*a* connected to skates 61 and 62 to move the skates and roller 23 laterally of the press.

A horizontally disposed perforated screen 68 extends from transverse frame member 35 towards end wall 33 and passes between the lower end of roller 23 and skate 62 to allow liquids to pass downwardly therethrough while retaining solids thereabove. Screen 68 is transversely slotted at 69 to enable the rollers to move laterally with respect thereto, and screen 68 is supported from underneath, as by support member 71.

Similarly an imperforate plate 72 extends from frame member 35 towards end wall 33 and passes between the upper end of roller 23 and skate 61 to close off the upper surface of the press box 11, plate 72 being slotted to allow lateral movement of roller 23 relative thereto.

In some uses of the press, it may be desirable to provide a power drive for roller 23. For such purpose, a fluid motor 76 is mounted on skate 61 for movement therewith and a drive connection 69 is provided from the motor to the axle of the roller.

Roller 24 is similarly mounted on skates 81 and 82 for lateral movement upon actuation of hydraulic cylinders 83 and 83*a*, and for powered rotation by fluid motor 84.

The degree of opening movement of rollers 23 and 24 is set by the use of adjustment shims 85 loosely mounted on the various pistons, these shims allowing the skates to move freely towards the hydraulic cylinders until they reach and are stopped by the shims.

As shown in FIG. 6, a scraper plate 86 is pivotally secured to column 87 of the frame end wall 33 and extends rearwardly into generally tangential engagement with the surface of roller 23 from the top to the bottom thereof. Tension springs 88 maintain such engagement even though roller 23 may be moved laterally towards or away from the center of the press. Scraper 89 is similarly mounted on column 90 and spring-biased into scraping engagement with the surface of roller 24.

Figure 9:
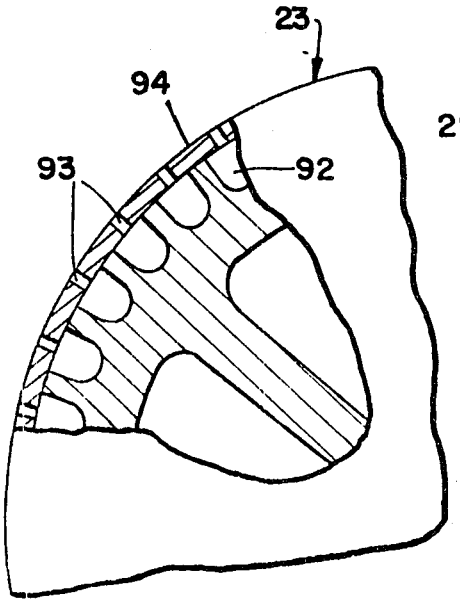
FIG. 9 is a horizontal sectional detail of one of the end rollers of the press of FIG. 5.

Referring now to FIG. 9, it will be noted that roller 23 has a plurality of vertical grooves 92 formed therein. These grooves extend along the length of the roller and are open at the bottom so that liquid passing through the apertures 93 of the screen 94 which covers the roller may drain downwardly from the roller through the grooves 92. Roller 24 is similarly constructed.

Figure 10:
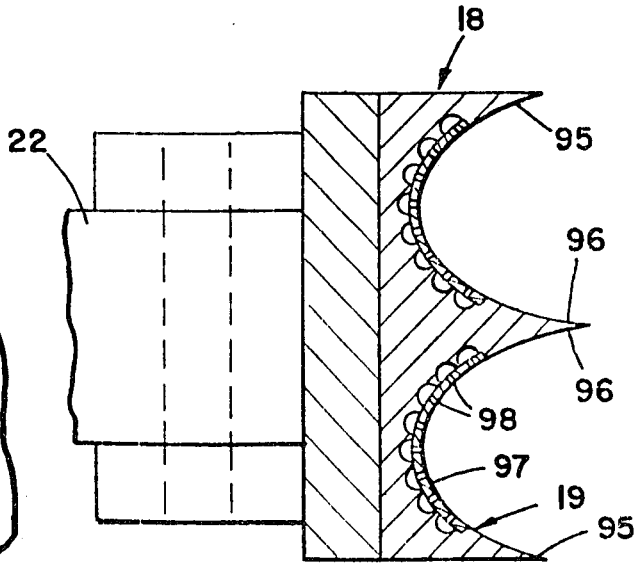
FIG. 10 is a horizontal sectional detail of the ram of FIG. 5.

As will be noted in FIG. 10, the forward face 19 of ram 18 has a double-concave shape, which provides forwardly extending scraper edges 95 from top to bottom of the ram and at the side edges thereof, and forwardly extending guide surfaces 96 which terminate along the vertical centerline of the ram. In order to increase drainage of liquid from the press, the forward face of the ram may be provided with apertured screens 97 which communicate with vertical grooves 98 in the ram, such grooves being open at the bottom of the ram so that liquid may drain from the ram and through the apertured bottom screen 40.

Figure 11:
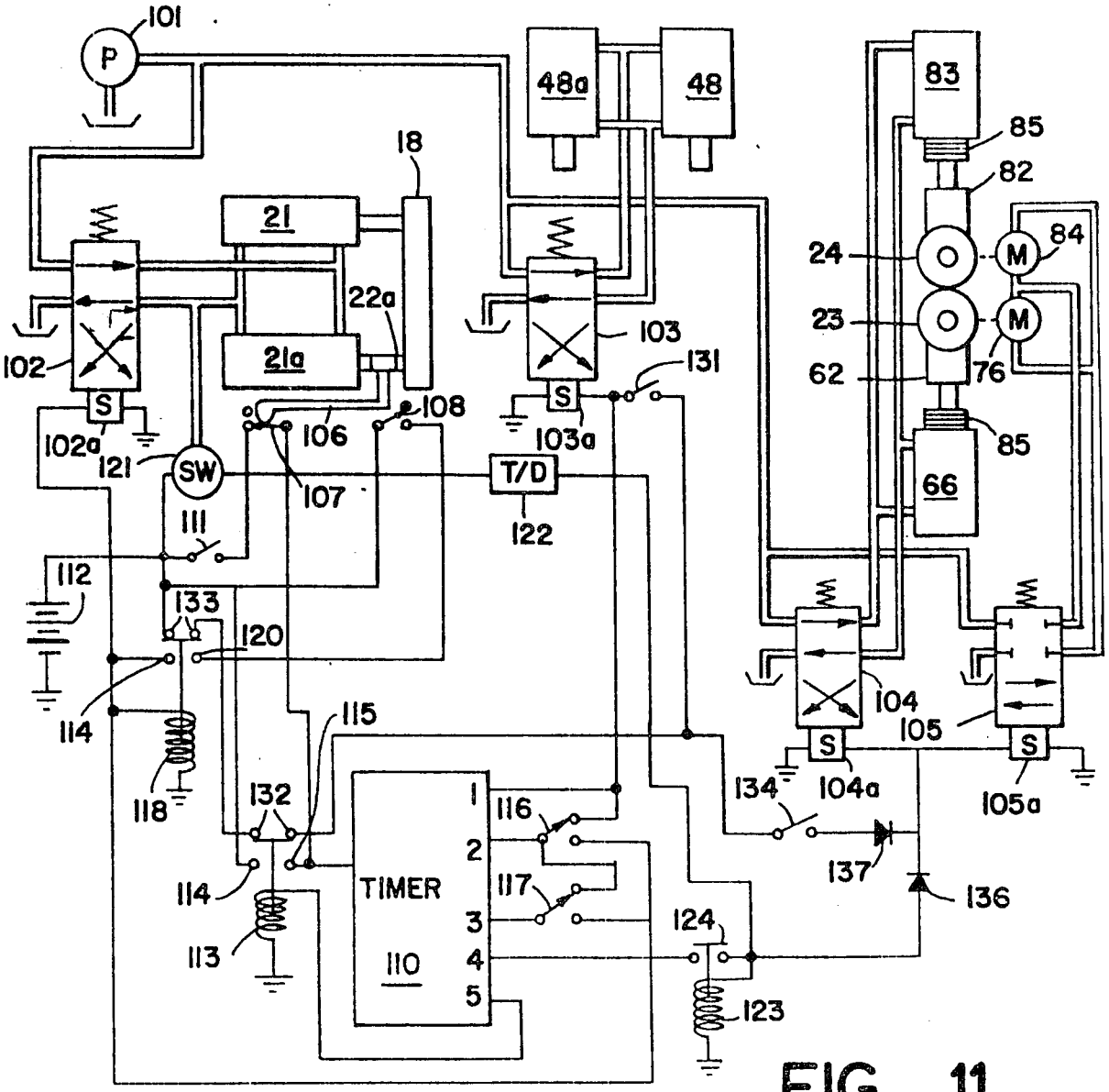
FIG. 11 is a circuit diagram of the electrical and hydraulic system of the press of FIG. 5.

FIG. 11 illustrates the hydraulic and electrical systems of the press. Fluid pump 101 takes hydraulic fluid from sump 100 and supplies fluid under pressure to valves 102, 103, 104 and 105. All of these valves are solenoid-operated and are normally spring-biased to the position shown in FIG. 11 when the solenoids are de-energized. As will be noted, when solenoid 102*a* is de-energized, valve 102 supplies fluid under pressure to the rod end of hydraulic cylinders 21 and 21*a* to maintain ram 18 in retracted position. Similarly, when solenoid 103*a* is de-energized, valve 103 supplies fluid under pressure to the head ends of cylinders 48 and 48*a* to maintain side wall 13 in closed position. With solenoids 104*a* and 105*a* de-energized, valve 104 supplies fluid under pressure to the head ends of cylinders 66 and 83 (and also 66*a* and 83*a*) so that rollers 23 and 24 are maintained in tangential contact to close that end of the press, while valve 105 blocks fluid from fluid motors 76 and 84. Suitable flow-restrictor devices (not shown) will be provided between the valves and cylinders controlled thereby to regulate the rate of admission of hydraulic fluid into the cylinders and thereby regulate the rate of piston movement.

A switch-actuating member 106 is secured to piston 22*a* for movement therewith. When piston 22*a* is retracted, member 106 will cause normally open microswitch 107 to close. Full extension of piston 22*a* will cause member 106 to move to a position where it opens the normally closed microswitch 108.

Timer 110 may be any conventional device which operates when voltage is applied to the input thereof and has the following sequence during a cycle of operation. At the start of the cycle, all timer outputs 1–5 are de-energized. When the cycle begins, timer output 5 becomes energized and stays energized until the end of the cycle. During the cycle voltage appears successively at timer outputs 1 through 4 for a predetermined time at each output and with a predetermined time being provided between the time that an output is deenergized and the time that the succeeding output is energized. A conventional motor-driven rotary-cam timer may be employed for such purpose with cams being used to close and open switches connecting the timer input with the timer outputs. The length of time each switch is actuated is determined by the shape of the cam, while the length of time between actuation of successive switches is determined by the relative placement of the cams on the cam shaft. If desired, a solid-state timer having chain-connected monostable multivibrator units may be employed for this purpose, such solid-state timers having an advantage in that the pulse length of each timer unit may be easily adjusted without affecting the pulse length of the other units.

OPERATION

At the start of a cycle of operation of the press, the elements thereof will be as shown in FIGS. 5–8 and 11. Ram 18 is retracted, side wall 13 is closed and rollers 23 and 24 are pressed together.

Main switch 111 (FIG. 11) is closed by the operator to connect battery 112 through main switch 111 and microswitch 107 to the input of timer 110. After timer 110 starts into operation, output 5 thereof becomes energized so that relay coil 113 closes its normally open contacts 114 and 115 to provide a holding circuit for timer 110 during the remainder of the cycle thereof. In due course, timer output 1 is energized and causes solenoid 103*a* to move valve 103 to a position wherein hydraulic cylinders 48 and 48*a* are pressurized to open side wall 13.

Pulp may now flow down by gravity from hopper 51 into the press. Since the opening of the side wall serves to enlarge the cross-section and volume of the press cylinder 11, entry of the pulp into the cylinder is facilitated by such enlargement.

When timer output 1 times out, solenoid 103*a* becomes de-energized and valve 103 connects hydraulic cylinders 48 and 48*a* to pump 101 so that the side wall 13 is forced back to closed position. The lateral compression applied to the pulp applies a first squeezing to the pulp and causes an initial separation of the liquid therefrom, such liquid flowing outwardly from the press box through the apertures of the screens at the sides, bottom and ends thereof.

Timer output 2 then becomes energized. With switch 116 connected as shown, solenoid 103*a* is again energized to cause side wall 13 to re-open so that more pulp can flow laterally into the press box 11 and again fill it. After timer output 2 is de-energized, side wall 13 again closes and applies a lateral compression to the pulp as before.

Timer output 3 now becomes energized. If switch 117 is in a position as shown, side wall 13 will again open to allow more pulp to enter press box 11 and will again close to apply lateral compression to the pulp.

These repeated "clam-shell" operations of side wall 13 are relatively low-pressure in nature (as compared to the ram operation discussed below), giving an initial squeezing to the pulp such that a relatively large volume of pulp can be entered into the press box 11 in a relatively short length of time.

Timer output 4 now becomes energized to energize solenoid 102*a*. Valve 102 is operated thereby to connect pump 101 to the head ends of hydraulic cylinders 21 and 21*a* so that ram 18 begins to move through the press cylinder 11 and apply axial compression to the mass of pulp therein. Relay coil 118 is also energized from timer output 4 and completes a holding circuit through relay contacts 119 and 120 and through microswitch 108 to battery 112.

As ram 18 moves forwardly, the switch actuating member 106 associated therewith allows microswitch 107 to open. Timer 110 continues to operate, however, since relay coil 113 maintains battery voltage at the timer input. The timer will continue to operate until the timer output 5 is de-energized. Relay coil 113 becomes de-energized and breaks the holding circuit for the timer, so that the operation thereof ceases with the timer homed at its fifth output.

As ram 18 moves through the press cylinder 11, the pressure on the pulp will increase, squeezing the pulp with more and more pressure to force the liquid therein out through the apertured screens of the press box.

The transverse pressure gradient on the pulp will be greatest adjacent the periphery of the mass so that liquid from that portion of the mass will first be squeezed out. This will cause the remaining solid components thereat to concentrate and form a surrounding filter cake through which the remaining liquid must pass. As more and more liquid is expelled the thickness of this filter increases, making it more and more difficult to remove the remaining liquid. In general, the greater distance of a portion of the mass from the periphery thereof, the harder it is to remove the liquid therefrom. The porosity of the filter formed during pressing will vary with the particular material being processed.

Materials such as grapes, which have relatively strong, rubbery skins, present substantial problems in the pressing of juice therefrom. Juice is extracted from whole grapes by applying pressure thereto to flatten the grapes to an extent that they will burst and release the semi-fluid contents thereof. The flattened skins migrate outwardly of the mass and build up in layers, which greatly impedes further passage therethrough of liquid. Furthermore, as the rate of flow of liquid therethrough reduces, the pressure internally of the mass will equalize on the remaining whole grapes so that they will not burst even though the applied force is very high.

The present invention alleviates these problems in a number of ways. First of all, the cross-sectional shape of the press box is preferably non-circular, in order to increase the ratio of perimeter to cross-sectional area. For example, in one embodiment of the invention illustrated herein, the height of the side walls 12 and 13 is 24 inches and the spacing therebetween (when closed) is 6 inches. Thus, for a cross-sectional area of 144 square inches, the periphery is 60 inches. If the press box 11 were circular in shape and had the same area, its circumference would be only approximately 42.5 inches.

The ratio of perimeter to cross-sectional area is also increased because the major diameter (the vertical height of the disclosed embodiment) is substantially greater than the minor diameter (the width of the disclosed embodiment). For example, if the press box 11 were square in shape and had a cross-sectional area of 144 square inches, its perimeter would be only 48 inches, as compared to the 60-inch-perimeter embodiment referred to above.

Thus, for a given volume of material, the increased periphery will result in a thinner layer of filter material through which the liquid must flow in order to be released from the press.

The fact that the major axis of the cross-sectional area of the press cylinder is substantially less than the minor axis thereof also means that the maximum distance that liquid must flow through the mass is substantially reduced. In the embodiment referred to above, no part of the mass is more than three inches from the periphery of the mass. If the press box 11 were circular in shape with the same cross-sectional area, almost a third of the mass would be more than three inches from the periphery thereof.

The particular shape of the ram face 19 serves several useful purposes in the present invention. First of all, as the ram travels through the press box, the forwardly extending side edges 95 peel the filter cake from the apertured side wall screens to clean the screens for the next cycle of operation. Further, as the ram moves forwardly, the relatively solid filter cake peeled from the side walls slides along the front surface of the ram and is directed forwardly by surfaces 96 so that the cake is pushed forwardly into the relatively fluid center of the mass. This pushed-forward cake in effect forms a wedge-shaped forward extension of the ram which transmits the ram pressure to the center of such mass so as to force the semi-fluid material thereat outwardly toward the periphery of the mass.

Initially, the rate of advance of ram 18 will be relatively great since the liquid can initially be pressed from the pulp rather easily. As more and more liquid is pressed therefrom and as the flow-impeding filter cake decreases in porosity, the rate of forward movement will decrease and the pressure exerted on the mass by the ram will increase. In the embodiment of the present invention referred to above, the design is such that the maximum pressure exertable by the ram on the mass is approximately 20 atmospheres. The control system is provided with a pressure-operated switch 121 connected to the head end of hydraulic cylinder 21*a* which closes at a hydraulic pressure slightly below that required to produce maximum ram pressure. Closing of switch 121 applies voltage from battery 112 through a conventional time delay device 122 to relay coil 123. When this coil is energized, its contacts 124 will close an energizing circuit to solenoid 104*a* so that valve 104 is actuated to cause hydraulic cylinders 66 and 83 to move the rollers 23 and 24 apart to the degree permitted by the thickness of shims 85.

The time delay provided by device 122 will allow full ram pressure to be maintained on the pulp to squeeze the liquid therefrom. The delay of timer device 122 is set, for the particular material being operated on, such that the major portion of the liquid that can be released with such pressure is squeezed from the pulp.

When time delay device 122 times out, valve 104 will be actuated to move the rollers 23 and 24 apart to form a restricted opening at the end of the press box 11. The desired size of the opening will depend upon the material being operated upon and the degree of dryness desired in the cake which is extruded therethrough. As is noted from the drawings, the discharge opening is in line with the longitudinal axis of the press box and centrally thereof, the discharge opening having a cross-sectional area with its major axis parallel to and substantially equal to the major axis of the press box and with its minor axis parallel to and substantially less than the minor axis of the press box.

With rollers 23 and 24 moved apart, the pressure of the ram 18 on the pulp will force the remaining contents of press box 11 through the restricted opening between the rollers. Whether the press requires the use, or presence, of fluid motors 76 and 84 or not will depend upon the nature of the particular pulp being processed. In some instances, the composition of the pulp may be such that the rollers will be rotated by the frictional engagement of the pulp as it is forced through the opening between the rollers. In other instances it may be desirable to provide a power assistance to the rollers to facilitate the extrusion of the pulp from the press. When power assistance is desired, valve 105 is actuated, during the time the rollers are moved apart, to supply fluid under pressure to fluid motors 76 and 84.

With the rollers open, the relatively moist pulp generally in the middle of the press box will first be forced out between the rollers so that the liquid therein can be squeezed out and released through the apertures of the rollers. The rotation of the rollers will continuously cause the surfaces to be cleaned by scrapers 86 and 89 so that open apertures will be brought continuously into action to ensure drainage from the pulp during this phase of the operation.

As the pulp is extruded, the advance of the ram 18 causes its outer shear edges to dislodge the filter cake from the side walls and move it inwardly to the center of the mass. Such action also causes the filter cake to reform so that the remaining fluid trapped therein is more easily released.

In due course, ram 18 will reach its full extension, and microswitch 108 will be opened. This breaks the holding circuits for relays 118 and 123 and for solenoids 102*a*, 104*a* and 105*a* so that valves 102, 104 and 105 return to their normal positions illustrated in FIG. 13. Ram 18 will now retract, rollers 23 and 24 will close and fluid motors 76 and 84 will be de-energized.

When ram 18 is fully retracted, microswitch 107 will again close (providing main switch 11 is still closed) to supply power to timer 110 so that another full cycle of operation will begin automatically.

If desired, switch 116 associated with timer output 2 may be set from the position shown so that the second and third cycles of opening and closing of side wall 13 are skipped and the ram 18 is started into operation as soon as the first cycle of operation of side wall 13 is completed. Similarly, switch 117 may be set from the illustrated position to allow ram operation to start after two clam-shell operations of side wall 13 have been completed.

Solenoid 103*a* is also connectable to battery 112 through manually operable switch 131 and the normally closed contacts 132 of relay 113 and the normally closed contacts 133 of relay 118. Such connection allows the operator to open side wall 13 for cleaning purposes at a time when the press is not in operation. Similarly, switch 134 may be closed to energize and move the rollers apart for cleaning or inspection at a time when the press is not in operation. Diode 136 prevents relays 123 and 118 from being energized by closure of switch 134, and diode 137 prevents solenoid 103*a* from being energized during a cycle of operation in the event switches 131 and 134 had accidentally been left in closed position.

As may be seen from the foregoing, the present invention provides a plurality of different squeezing actions on the pulp being processed. The pulp is pressed laterally during the portion of the cycle when the press box is filled. The ram 18 then applies axial pressure over a relatively large cross-sectional area of the pulp to provide a relatively slow squeezing of the liquid from the pulp, with the filtering capabilities of the compressed solids being utilized to retain minute solid particles in the mass. The rollers then open to permit a relatively rapid extrusion of the solids from the end of the press in the form of a cake having a relatively small cross-sectional area with lateral pressure being applied to the extruding solids to remove liquid therefrom. During the extruding portion of the cycle, the mass of pulp is acted upon so that the relatively moist central part of the pulp mass is first exposed to the pressure of rollers 23 and 24 as it is extruded therefrom, followed by the relatively dry portion of the mass which is broken up and reformed so that trapped liquids may be released.

During a full cycle of operation, squeezing pressure is applied to the pulp at all times except when the side wall 13 is opened for filling and when the ram 18 is being retracted. Since the opening of the side wall causes an enlargement of the press box 11, entry of new pulp thereinto is facilitated so that these portions of the cycle are relatively short. Also, since the stroke of the ram 18 is no more than the length of press box 11, the full forward stroke of the ram is used for pressing and the time required for ram retraction is quite short. As a consequence, the press provides an almost continuous pressing operation.

With regard to the previously mentioned embodiment wherein the side walls are 24 inches in height and spaced six inches apart, the length of the ram stroke is 30 inches. A total cycle of operation of two minutes enables 4 tons of grape pulp to be pressed per hour.

The design of the present press is also advantageous in that it is easy to provide an air-tight shield around the whole press so that an inert gas, such as carbon dioxide or nitrogen, may be used to surround the press and prevent oxidation of the material being pressed.

Even if such a non-oxidizing atmosphere is not provided, the present press is very advantageous in that the very short length of total cycle time will minimize the time and area of exposure of the juice to oxidation, enzymatic browning and loss of volatile fragrances.

Because of its ability to operate in a substantially continuous manner within a very short cycle time, the present press has a very small ratio of size and weight per volume of pulp processed per unit time. Moreover, the short stroke design of ram 18 and the relatively small degree of side opening of press box 11 results in a very compact arrangement with minimal length and width. These features are of considerable importance since it allows the present press to be mounted on a wheeled vehicle and used in the field during harvesting. For example, in the mechanical harvesting of grapes, a harvesting machine is driven down rows of grapevines to harvest grapes therefrom. At present, these grapes are discharged into wheeled hoppers traveling with the harvesting machine, the hoppers then being transported to a winery for pressing. With the present press mounted on a wheeled vehicle, grapes can be discharged from a harvesting machine directly into the hopper of the press for field pressing of the liquid therefrom.

Figure 12:
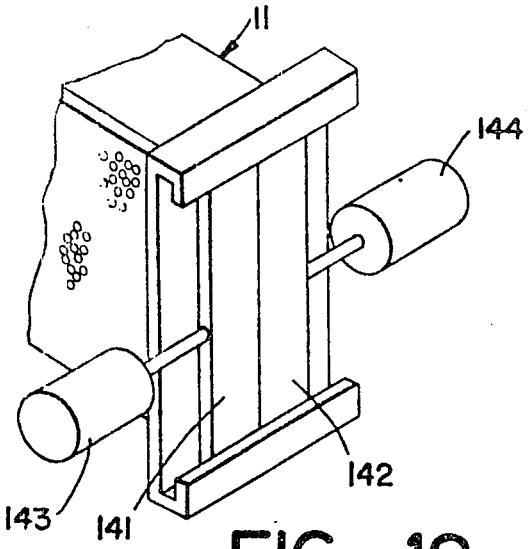
FIG. 12 is a simplified perspective view of a modification of the end portion of the press through which the solids are extruded.

Although the use of rollers 23 and 24 is preferable, the end of the press box 11 may be closed by other means, if desired. For example, a closure means as illustrated in FIG. 12 may be used, wherein a pair of gates 141 and 142 are provided at the discharge end of press box 11, the gates being mounted for sliding movement in a plane transverse to the axis of press box 11 and actuated by hydraulic cylinders 143 and 144 which open and close the gates at the same time in a full cycle of operation as rollers 23 and 24 are opened and closed. Gates 141 and 142 are preferably provided with apertured screens on the inner sides thereof for drainage and suitable stop members are provided to limit the degree of opening movement of the gates.

Figure 13:
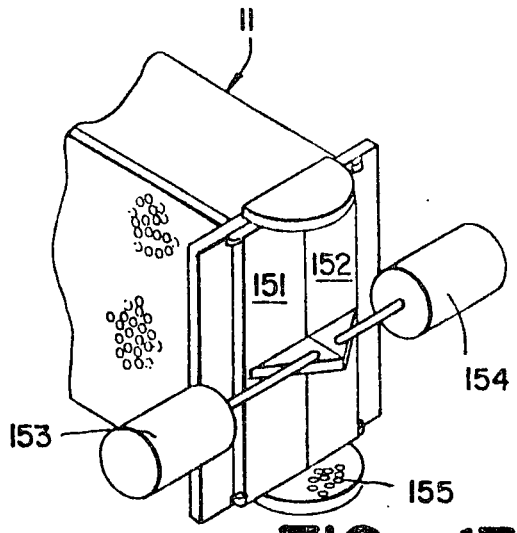
FIG. 13 is a simplified perspective view of a further modification of the end portion of the press through which the solids are extruded.

FIG. 13 illustrates another form of closure means, wherein a pair of gates 151 and 152 are hinged along their edges for pivotal movement about vertical axes. Hydraulic cylinders 153 and 154 are utilized to open the gates and provide a desired spacing between their adjacent vertical edges and to close the gates. The inner surfaces of the gates are provided with apertured screens and discharge passages which allows liquid to drain down and pass through the apertured base plate 155.

We claim:

1. A press for separating liquid and solid components of pulpy material comprising:

(a) a horizontal press box having a uniform cross-sectional area and shape along the length thereof, the major axis of the cross-sectional area being substantially greater than the minor axis thereof, said press box having apertured and opposed side walls;

(b) means for opening said press box to enable pulpy material to be fed laterally into said press box and for thereafter closing said press box;

(c) a ram having a retracted position wherein the face of the ram forms a closure for one end of said press box, said ram having a cross-sectional area and shape substantially equal to the internal cross-sectional area and shape of said press box;

(c) ram operating means for moving said ram from its retracted position axially through said press box to its other end and then back to said retracted position;

(d) closure means disposed at said other end of said press box for closing and opening said other end of said press box;

(e) closure operating means for moving said closure means between a closed position wherein said closure means closes said other end of said press box and an open position wherein said closure means forms a discharge opening centrally at said other end of said press box, said discharge opening having a cross-sectional area with its major axis parallel to and substantially equal to the major axis of the cross-sectional area of said press box at said other end thereof, said discharge opening having the minor axis thereof parallel to and substantially less than the minor axis of the cross-sectional area of the minor axis of said press box at said other end thereof.

2. A press as set forth in claim 1 wherein said closure means comprises a pair of elongated and parallel rollers rotatably mounted at said other end of said press box and wherein said closure operating means includes means for applying a force to said rollers to force said rollers to the closed position wherein said rollers are in tangential engagement with each other and for removing said force and for moving said rollers apart to the open position wherein the rollers are spaced apart from each other.

3. A press as set forth in claim 2 wherein said ram includes means for peeling material from said side walls during forward movement of said ram from its retracted position towards said other end of said press box and for forcing said peeled material to move forwardly from said ram and into the center of said press box during said forward movement of said ram.

4. A press box as set forth in claim 3 wherein said ram operating means includes a pressure cylinder, a source of fluid under pressure and means for admitting said fluid under pressure into said pressure cylinder to force said ram from its retracted position to said other end of said press box, and wherein said closure operating means includes means for moving said closure means to open position at a predetermined time after the pressure in said pressure cylinder has reached a predetermined pressure.

5. A press as set forth in claim 1 wherein said ram includes means for peeling material from said side walls during forward movement of said ram from its retracted position towards said other end of said press box and for forcing said peeled material to move forwardly from said ram and into the center of said press box during said forward movement of said ram.

6. A press box as set forth in claim 1 wherein said means for opening said press box includes means for mounting one of said side wall members for movement away from the other side wall member to increase the internal cross-sectional area of said cylinder and to form a top opening into said press box and for movement back towards said other side wall member to close said top opening and includes means for moving said side wall members away from and forcibly back towards each other.

7. A press as set forth in claim 6 wherein said ram includes means for peeling material from said side walls during forward movement of said ram from its retracted position towards said other end of said press box and for forcing said peeled material to move forwardly from said ram and into the center of said press box during said forward movement of said ram.

8. A press as set forth in claim 6 wherein said ram operating means includes a pressure cylinder, a source of fluid under pressure and means for admitting said fluid under pressure into said pressure cylinder to force said ram from its retracted position to said other end of said press box, and wherein said closure operating means includes means for moving said closure means to open position at a predetermined time after the pressure in said pressure cylinder has reached a predetermined pressure.

9. A press as set forth in claim 8 wherein said ram includes means for peeling material from said side walls during forward movement of said ram from its retracted position towards said other end of said press box and for forcing said peeled material to move forwardly from said ram and into the center of said press box during said forward movement of said ram.

10. A press box as set forth in claim 1 wherein said ram operating means includes a pressure cylinder, a source of fluid under pressure and means for admitting the fluid under pressure into said pressure cylinder to force said ram from its retracted position to said other end of said press box, and wherein said closure operating means includes means for moving said closure means to open position at a predetermined time after the pressure in said pressure cylinder has reached a predetermined pressure.

11. A press for separating liquid and solid components of pulpy material comprising:

(a) a press box having apertured walls and having a uniform cross-sectional area along the length thereof;

(b) a ram having a retracted position wherein the face of the ram forms a closure for one end of said press box, said ram having a cross-sectional area and shape substantially equal to the internal cross-sectional area and shape of said press box;

(c) operating means for moving said ram from its retracted position axially through said press box to the other end thereof and then back to said retracted position;

(d) closure means disposed at said other end of said press box for closing and opening said other end of said press box;

(e) said ram including means projecting forwardly from the edges and central portion of the face of the ram for peeling material from the walls of said press box upon forward movement of said ram from its retracted position towards the other end of said press box and for forcing said peeled material to move forwardly from said ram and into the center of said press box during said forward movement of said ram.

12. A press as set forth in claim 11 and further including means for opening said closure means to provide a restricted discharge opening centrally of said press box at said other end thereof, said discharge opening having a cross-sectional area substantially less than the cross-sectional area of said press box.

13. A press as set forth in claim 12 wherein said press box includes opposed side walls along the length thereof and further including means for moving one of said side walls away from the other side wall to increase the internal cross-sectional area of said press box and to form a top opening into said press box and for moving said one side wall back toward said other side wall to close said top opening and decrease the internal cross-sectional area of said press box.

* * * * *